US007091165B2

(12) United States Patent
Jo et al.

(10) Patent No.: US 7,091,165 B2
(45) Date of Patent: Aug. 15, 2006

(54) COMPOSITION AND METHOD FOR REMOVING COPPER-COMPATIBLE RESIST

(75) Inventors: Gyoo-Chul Jo, Gunpo-si (KR); Gee-Sung Chae, Incheon (KR); Oh-Nam Kwon, Cheonan-si (KR); Kyoung-Mook Lee, Seoul (KR); Yong-Sup Hwang, Suwon-si (KR); Seong-Bae Kim, Seoul (KR); Suk-Chang Jang, Yesan-gun (KR)

(73) Assignees: LG.Philips LCD Co., Ltd., Seoul (KR); Dongjin Semichem Co., Ltd., Incheon (KR)

( * ) Notice: Subject to any disclaimer, the term of this patent is extended or adjusted under 35 U.S.C. 154(b) by 183 days.

(21) Appl. No.: 10/694,951

(22) Filed: Oct. 29, 2003

(65) Prior Publication Data

US 2004/0127374 A1 Jul. 1, 2004

(30) Foreign Application Priority Data

Dec. 30, 2002 (KR) ..... 10-2002-0087408

(51) Int. Cl.
*C11D 1/00* (2006.01)

(52) U.S. Cl. ..... 510/175; 510/176; 134/3

(58) Field of Classification Search ..... None
See application file for complete search history.

(56) References Cited

U.S. PATENT DOCUMENTS

| | | | | |
|---|---|---|---|---|
| 3,653,931 | A * | 4/1972 | Borchert et al. | 106/3 |
| 4,803,008 | A * | 2/1989 | Ciolino et al. | 510/419 |
| 5,401,326 | A * | 3/1995 | Mihelic et al. | 510/185 |
| 5,705,089 | A * | 1/1998 | Sugihara et al. | 252/79.1 |
| 6,173,776 | B1 * | 1/2001 | Furman et al. | 166/279 |
| 6,228,823 | B1 * | 5/2001 | Morinaga et al. | 510/175 |
| 6,265,309 | B1 * | 7/2001 | Gotoh et al. | 438/637 |
| 6,274,296 | B1 * | 8/2001 | Chu | 430/331 |
| 6,350,560 | B1 * | 2/2002 | Sahbari | 430/325 |
| 6,585,825 | B1 * | 7/2003 | Skee | 134/3 |
| 6,716,803 | B1 * | 4/2004 | Kakizawa et al. | 510/175 |
| 6,869,921 | B1 * | 3/2005 | Koito et al. | 510/176 |

* cited by examiner

*Primary Examiner*—Gregory Webb
(74) *Attorney, Agent, or Firm*—McKenna Long & Aldridge LLP

(57) ABSTRACT

A composition for removing a copper-compatible resist includes: about 0.1% to about 10% by weight of an alkylbenzenesulfonic compound; about 10% to about 99% by weight of a glycolether compound; and about 0.5% to about 5% by weight of a corrosion inhibitor.

17 Claims, 8 Drawing Sheets

COMPOSITION AND METHOD FOR REMOVING COPPER-COMPATIBLE RESIST

This application claims the benefit of Korean Patent Application No. 2002-87408, filed on Dec. 30, 2002, which is hereby incorporated by reference for all purposes as if fully set forth herein.

BACKGROUND OF THE INVENTION

1. Field of the Invention

The present invention relates to a composition for removing a copper (Cu)-compatible resist, and more particularly, to a composition for removing a copper-compatible resist without corrosion of copper.

2. Discussion of the Related Art

In general, a low resistance copper line is commonly used as an array line of an array substrate for a liquid crystal display (LCD) device, or in a circuit line of a semiconductor device to prevent resistance-capacitance (RC) delay. A copper layer for the copper line is formed through a chemical vapor deposition (CVD) method, an atomic layer deposition (ALD) method, an electroless deposition method, or an electroplating method as an electrochemical deposition method. The copper line is commonly formed using a photolithographic process incorporating fine pattern technology. The photolithographic process is commonly used for fabricating semiconductor devices such as large scale integrated (LSI) circuits, very large scale integrated (VLSI) circuits, and display devices including an LCD device and a plasma panel display (PDP) device.

FIG. 1 is a perspective view of a liquid crystal display device using a copper line according to the related art.

In FIG. 1, a liquid crystal display (LCD) device 11 includes an upper substrate 5, a lower substrate 10, and a liquid crystal layer 9 interposed between the upper and lower substrates 5 and 10. The upper substrate 5 includes a color filter layer 7, a black matrix 6, and a common electrode 18. The lower substrate 10 includes a pixel electrode 17 formed at a pixel region "P," a switching element "T," and an array line. Thin film transistors (TFTs) "T" as a switching element are disposed in a matrix configuration, and gate and data lines 14 and 22 are connected to each of the TFTs "T." The pixel region "P" is defined by the gate and data lines 14 and 22, and the transparent pixel electrode 17 is formed at the pixel region "P." The pixel electrode 17 and the common electrode 18 are made of a transparent conductive metal such as indium-tin-oxide (ITO) and indium-zinc-oxide (IZO). The LCD device 11 is driven by utilizing an electro-optical effect of the liquid crystal layer 9. Accordingly, the gate line 14 should be made of a low resistance material such as copper (Cu) and copper/titanium (Cu/Ti).

FIG. 2 is a schematic cross-sectional view of an array substrate for a liquid crystal display device according to the related art.

In FIG. 2, a gate electrode 30 and a gate line 14 (of FIG. 1) are formed on a substrate 10 by depositing and patterning a conductive metallic material such as aluminum (Al), chromium (Cr), molybdenum (Mo) and copper (Cu). A first insulating layer (a gate insulating layer) 32 is formed on the gate electrode 30 and the gate line 14 (of FIG. 1). An active layer 34 of intrinsic amorphous silicon (a-Si:H) and an ohmic contact layer 36 of impurity-doped amorphous silicon (n+or p+ a-Si:H) are formed on the first insulating layer 32 over the gate electrode 30. Source and drain electrodes 38 and 40 are formed on the ohmic contact layer 36 by depositing and patterning a conductive metallic material such as aluminum (Al), chromium (Cr), molybdenum (Mo) and copper (Cu). At the same time, a data line 22 connected to the source electrode 38 is formed on the first insulating layer 32. A second insulating layer (a passivation layer) 42 is formed on the source and drain electrodes 38 and 40, and the data line 22. A transparent pixel electrode 17 connected to the drain electrode 40 is formed on the second insulating layer 42.

Array lines such as the gate line 14 (of FIG. 1) and the data line 22 can be made of Cu having a low resistance. The Cu line can be used as a metal line of a semiconductor device.

FIGS. 3A to 3E are cross-sectional views showing a photolithographic process of a copper line for a liquid crystal display device or a semiconductor device according to the related art.

In FIG. 3A, a metal layer 62 is formed on a substrate 60 by depositing a metallic material for a metal line. A semiconductor substrate (a wafer) or a glass substrate can be used as the substrate 60. Next, a photoresist (PR) layer 64 of positive or negative type is formed on the metal layer 62. For example, a positive type PR layer will be illustrated in FIGS. 3A to 3E. Even though the PR layer 64 may be formed on an entire or a predetermined region of the substrate 60, the PR layer 64 is generally formed on the entire region of the substrate 60.

In FIG. 3B, a photo mask 66 having a predetermined pattern is disposed over the PR layer 64 of the substrate 60. Next, an exposure process is performed, wherein light "L" such as an ultra violet (UV) ray and an X ray is irradiated onto the photo mask 66. The photo mask 66 includes a transmitting portion "E" and a shielding portion "F," wherein the light passing through the transmitting portion "E" transforms the PR layer 64. Accordingly, the PR layer 64 includes a first portion "C" where a material property of the PR layer 64 is maintained and a second portion "D" where a material property of the PR layer 64 is transformed. Since the PR layer 64 is potentially patterned according to the photo mask 66, this pattern of the PR layer 64 is referred to as a latent image.

In FIG. 3C, the PR layer 64 (of FIG. 3B) having the latent image is developed to form a resist pattern 65 that corresponds to the photo mask 66 (of FIG. 3B). Specifically, the first portion "C" (of FIG. 3B) where the light "L" (of FIG. 3B) is not irradiated remains to cover the metal layer 62 and the second portion "D" (of FIG. 3B) where the light "L" (of FIG. 3B) is irradiated is eliminated to expose the metal layer 62.

In FIG. 3D, the metal layer 62 (of FIG. 3C) is etched using the resist pattern 65 as an etching mask, whereby a metal line 68 of a specific shape is formed on the substrate 60.

In FIG. 3E, the resist pattern 65 (of FIG. 3D) is eliminated, and the metal line 68 of the specific shape is exposed.

However, the metal line of copper may be easily corroded by conventional solvents used for removing the resist pattern. Accordingly, an advantage of the present invention is to eliminate the resist pattern 65 on the metal line 68 without corrosion of the metal line 68. Solvent compositions that include a corrosion inhibitor for preventing corrosion of copper may be used, as demonstrated by U.S. Pat. Nos. 5,417,877 and 5,556,482, which are hereby incorporated by references for all purposes as if fully set forth herein. The corrosion inhibitors include monoethanolamine (MEA) as a preferred amine. In addition, a specific amount of corrosion inhibitor is required so that a removing property of the inhibitor is not degraded.

FIG. 4 is a scanning electron microscope (SEM) image showing a corrosion state of a copper line when a solvent composition including conventional amine is used.

In FIG. 4, when a resist pattern is eliminated by using a solvent composition including conventional amine, corrosion of a copper line is not prevented. As a result, the copper line is also eliminated due to a galvanic effect, and a fragment of the copper line is laid on a glass substrate. Accordingly, reliability of the metal line is reduced due to such a defect.

Solvent compositions that include an organic acid for eliminating a resist pattern may be used, as demonstrated by U.S. Pat. No. 4,242,218, which is hereby incorporated by reference for all purposes as if fully set forth herein. A solvent composition of petroleum compound having 1–14 carbon chain classified into alkylsulfonic acid and alkylallyl is suggested. Dodecylbenzenesulfonic acid and toluenesulfonic acid are disclosed as arylsulfonic acid. However, the solvent compound having an organic acid causes severe corrosion of a copper line when a corrosion inhibitor is not added.

SUMMARY OF THE INVENTION

Accordingly, the present invention is directed to a composition for removing a copper-compatible resist that substantially obviates one or more of problems due to limitations and disadvantages of the related art.

An advantage of the present invention is to provide a composition that removes a copper-compatible resist without corrosion of copper.

Another advantage of the present invention is to provide a composition for removing a copper-compatible resist that minimizes a galvanic effect when another metal is used for a lower layer and removes the copper-compatible resist without corrosion of copper and another metal.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a composition for removing a copper-compatible resist may, for example, include about 0.1% to about 10% by weight of an alkylbenzenesulfonic compound; about 10% to about 99% by weight of a glycolether compound; and about 0.5% to about 5% by weight of a corrosion inhibitor.

In another aspect of the present invention, a method of fabricating an array substrate for a liquid crystal display device may, for example, include forming a gate line and a gate electrode of copper on a substrate through a photolithographic process using a photoresist; removing the photoresist remaining after forming the gate line and the gate electrode with a composition including about 0.1% to about 10% by weight of an alkylbenzenesulfonic compound, about 10% to about 99% by weight of a glycolether compound, and about 0.5% to about 5% by weight of a corrosion inhibitor; forming a first insulating layer on the gate line and the gate electrode; forming a semiconductor layer on the first insulating layer over the gate electrode; forming source and drain electrodes on the semiconductor layer, and a data line connected to the drain electrode; forming a second insulating layer on the source and drain electrodes and the data line; and forming a pixel electrode on the second insulating layer.

In another aspect, a method of fabricating a copper line for a semiconductor device may, for example, include forming an oxide film on a semiconductor substrate; forming a barrier metal pattern on the oxide film; forming a copper pattern on the barrier metal pattern through a photolithographic process using a photoresist; and removing the photoresist remaining after forming the copper pattern with a composition including about 0.1% to about 10% by weight of an alkylbenzenesulfonic compound, about 10% to about 99% by weight of a glycolether compound, and about 0.5% to about 5% by weight of a corrosion inhibitor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Figure 1:
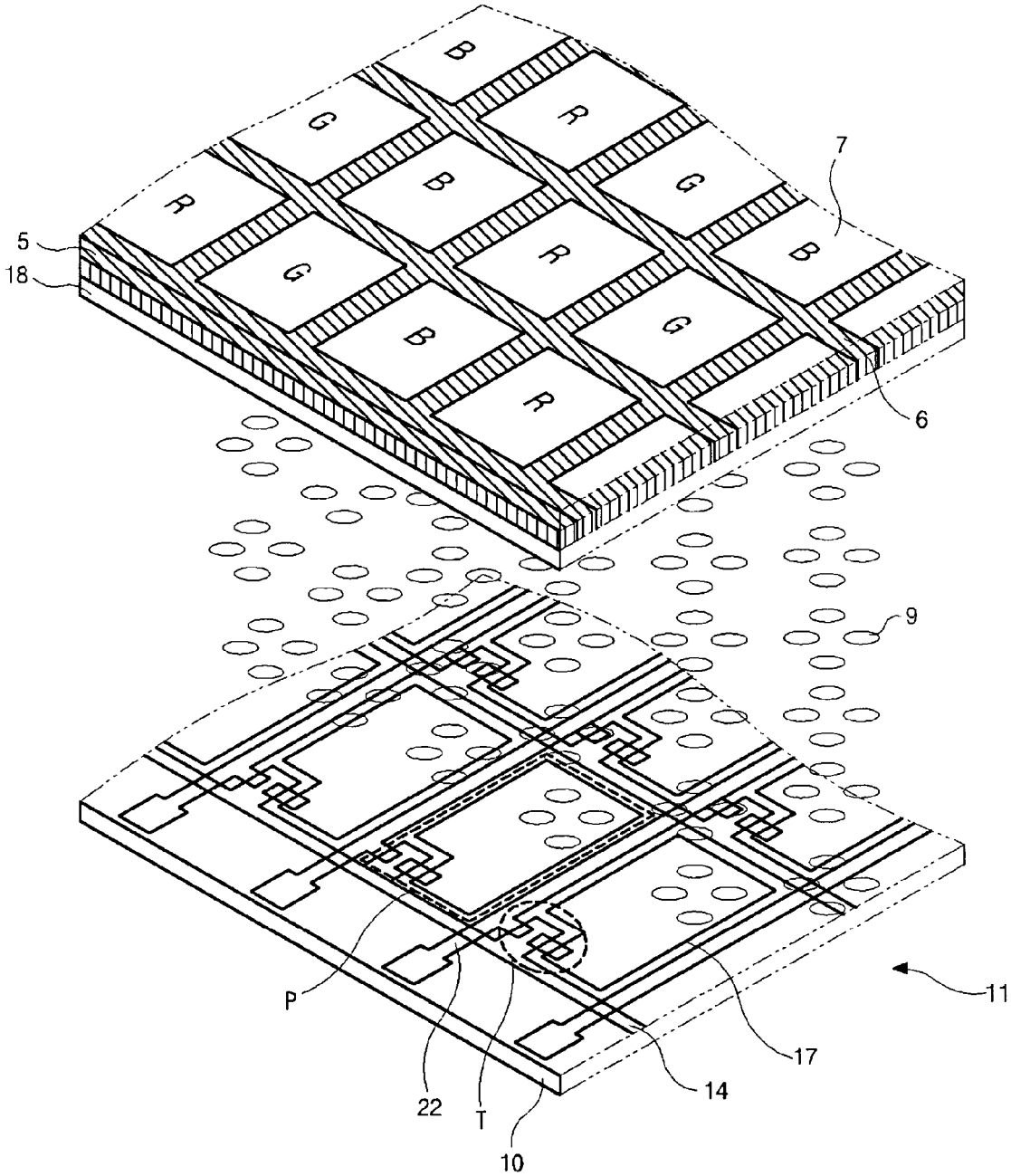
(related art) FIG. 1
FIG. 1 is a perspective view of a liquid crystal display device using a copper line according to the related art.
Figure 2:
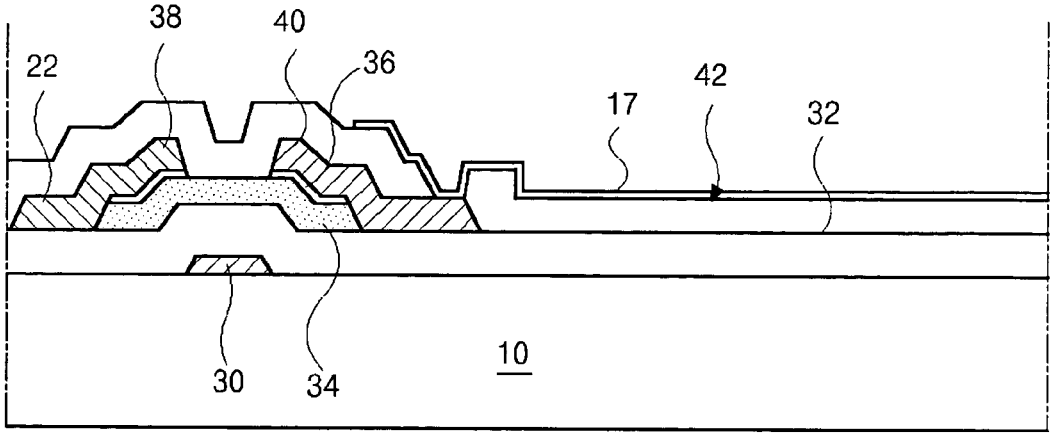
(related art) FIG. 2
FIG. 2 is a schematic cross-sectional view of an array substrate for a liquid crystal display device according to the related art.
Figure 3A:
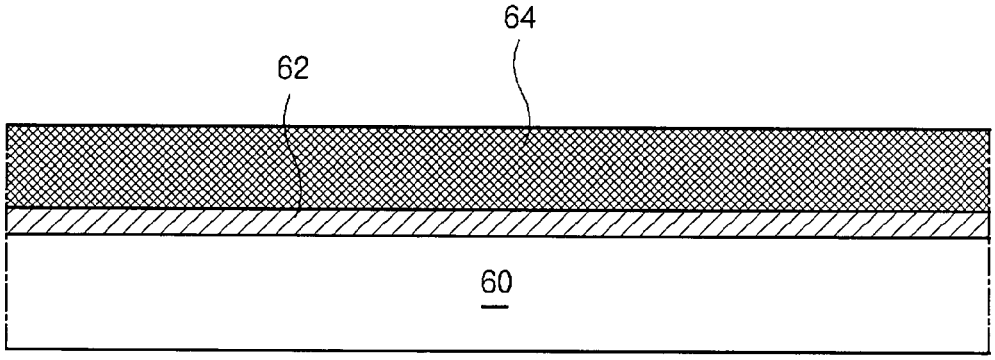
(related art) FIG. 3A
FIGS. 3A to 3E are cross-sectional views showing a photolithographic process of a copper line for a liquid crystal display device or a semiconductor device according to the related art.
Figure 3B:
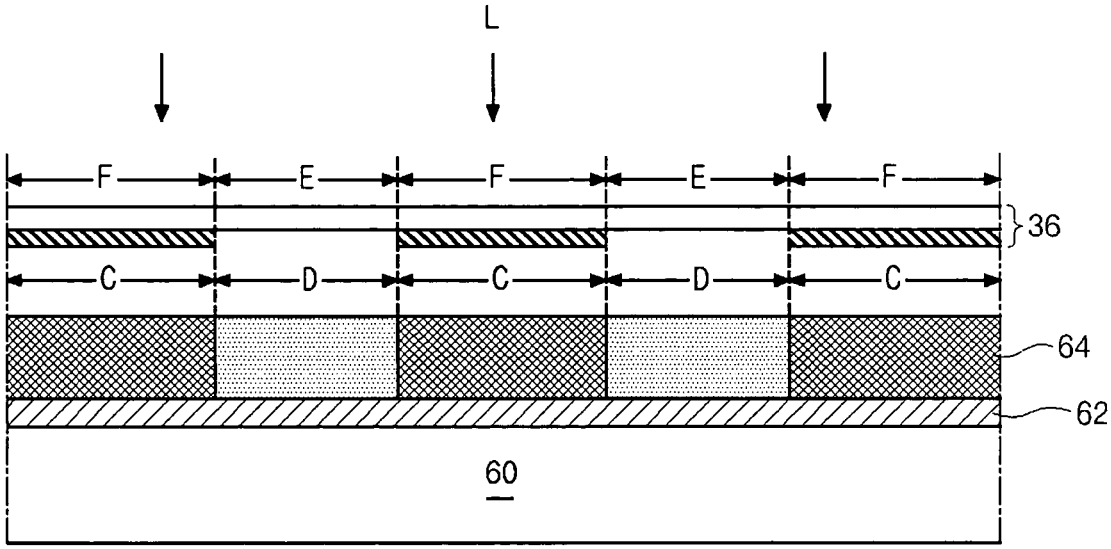
(related art) FIG. 3B
Figure 3C:
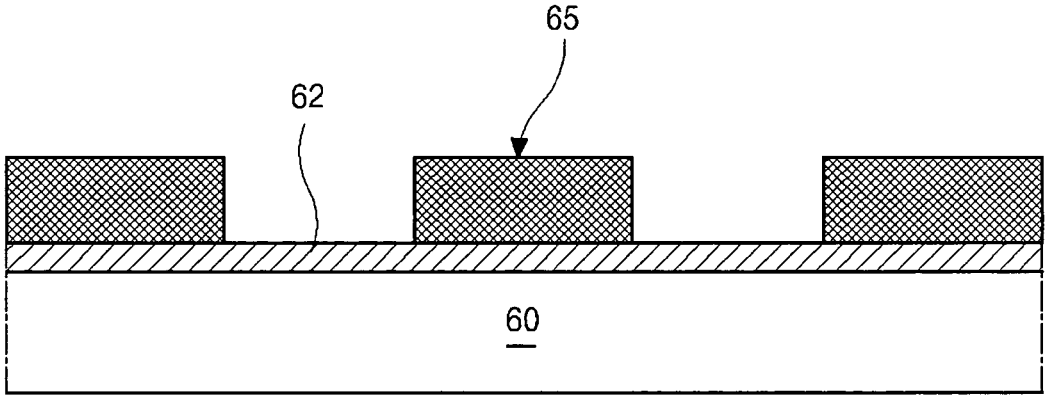
(related art) FIG. 3C
Figure 3D:
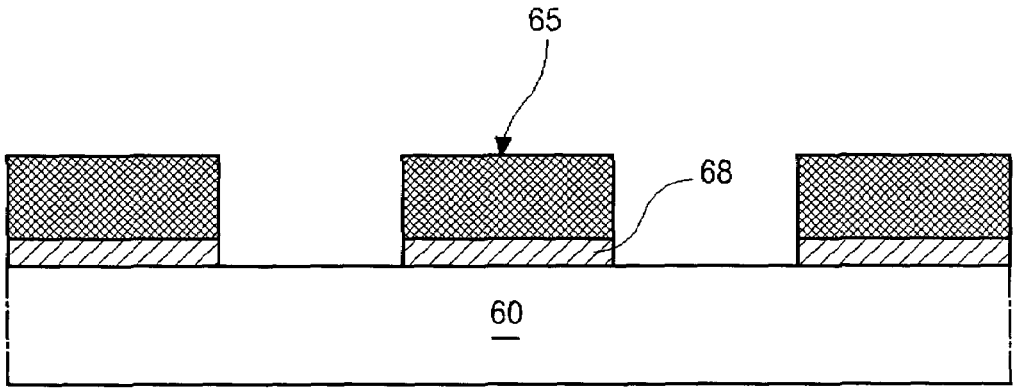
(related art) FIG. 3D
Figure 3E:
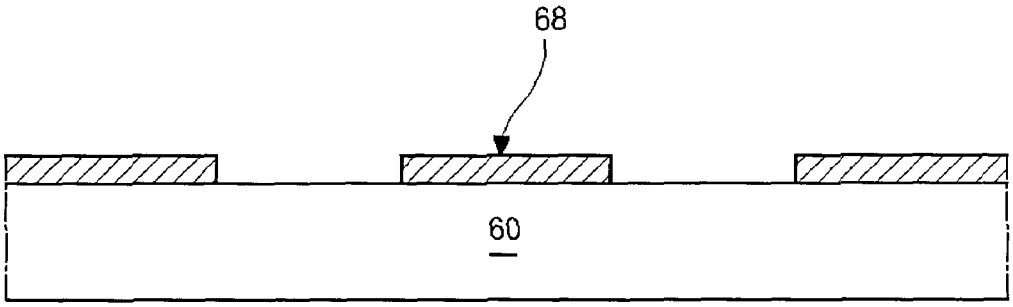
(related art) FIG. 3E
Figure 4:
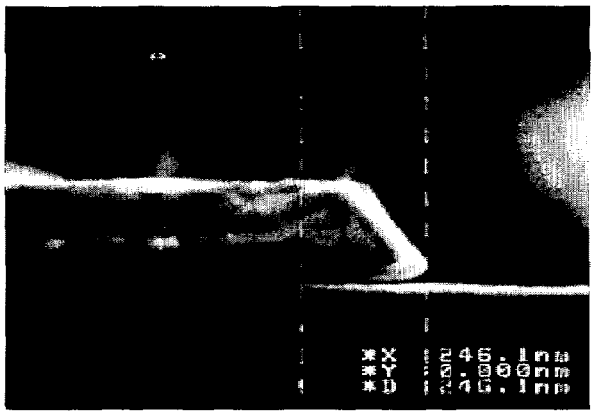
(related art) FIG. 4
FIG. 4 is a scanning electron microscope (SEM) image showing a corrosion state of a copper line when a solvent composition including conventional amine is used.

Reference will now be made in detail to embodiments of the present invention, example of which is illustrated in the accompanying drawings. Wherever possible, similar reference numbers will be used throughout the drawings to refer to the same or like parts.

An exemplary composition for removing a copper-compatible resist according to the present invention may include a benzenesulfonic acid as an alkylbenzenesulfonic acid compound. The benzenesulfonic acid compound, which is a strong acid material, may penetrate into a polymer matrix of a resist that may have been transformed or cross-linked through a wet or dry etching process, an ashing process or an ion implantation process, for example. Accordingly, the alkylbenzenesulfonic acid compound may break an attraction of the internal molecules, or may interrupt an interaction between the molecules. The alkylbenzenesulfonic acid compound, which is an excellent surface activator having a high activity of hydrogen ions, may transform the resist into a shapeless polymer cluster of a gel state by forming vacancies in weak portions of the resist on the copper line, and the resist may be removed.

In general, corrosion of copper may be independent of the basicity. The alkylbenzenesulfonic acid compound functions as a reducing agent and severely corrodes a copper line when a corrosion inhibitor is not added. When the alkylbenzenesulfonic acid ratio of the alkylbenzenesulfonic compound is over about 10% by weight, corrosion of copper cannot be controllable. Moreover, since the alkylbenzenesulfonic acid is a solid powder, the alkylbenzenesulfonic acid is not volatile and is concentrated in a liquid. Accordingly, a minimum amount of the alkylbenzenesulfonic acid may be included by the exemplary composition for removing a copper-compatible resist.

The exemplary composition for removing a copper-compatible resist according to the present invention may include about 10% to about 99% by weight, preferably about 85% to about 99% by weight, of a glycolether solvent for dissolving resin of the resist. When a molecular weight of the glycolether solvent is more than about 150, dissolving activity is reduced and solubility of the resist decreases. The dissolving activity of benzenesulfonic acid is reduced according to reduction of the dissolving activity of the glycolether solvent. Thus, the glycolether solvent may have a molecular weight less than about 150. Moreover, compounds without ether bonds, i.e., alkyleneglycol compounds, may corrode a copper line resulting in pinholes on surfaces of the copper line.

Conversely, excellent dissolving activity of glycolether solvent may be obtained by using diethyleneglycolmethylether or diethyleneglycolethylether, which has boiling points of more than about 180° C. and may be easily mixed with water. Accordingly, even when the resist is removed during a high temperature process, a composition ratio of the glycolether solvent may be kept constant because of the relatively high boiling point of the glycolether solvent. Thus, a removal rate of the copper-compatible resist can be made constant throughout the entire removing process. In addition, when the glycolether solvent has a boiling point of more than about 180° C., a surface tension between the resist and the copper line may be reduced, thereby increasing resist removal efficiency. Moreover, since the glycolether solvent has a relatively low freezing point and a relatively high ignition point, the glycolether solvent is relatively safe for storage.

The exemplary composition for removing a copper-compatible resist according to the present invention may include about 0.5% to about 5% by weight of at least one corrosion inhibitor selected from a material group including: succinic acid, benzonic acid and citric acid of antioxidant, tolyltriazole, benzotriazole, aminotriazole, carboxylbenzotriazole, mercaptobezotriazole, mercaptoethanol, mercaptopropanediol, and mercaptosuccinic acid. The corrosion inhibitor is effective for a reaction where oxygen is reduced on a surface of copper or aluminum, i.e., an oxidation reaction where an oxide film is generated. The corrosion inhibitor reacts with a copper oxide or an aluminum oxide to form a copper or aluminum complex compound in a liquid. The complex compound remaining on a surface functions as electrical and physical protection layers to prevent a surface corrosion and a galvanic effect.

Table 1 shows ratios of several compositions for removing a resist and resulting corrosion degrees according to the present invention. Table 1 is a result of a first test for selecting an optimum ratio of an alkylbenzenesulfonic acid and a glycolether solvent.

TABLE 1

| | Compositions for Removing Resist | | | | | | | | | | Corrosion |
|---|---|---|---|---|---|---|---|---|---|---|---|
| | Amine Compound | | Glycolether Solvent | | Additive 1 | | Additive 2 | | Additive 3 | | Degree dipping |
| | kind | wt % | kind | wt % | kind | wt % | kind | Wt % | kind | wt % | 30 min. |
| Condition 1 | BSA | 0.2 | DEGEE | 99.3 | MSA | 0.5 | — | — | — | — | 1 |
| Condition 2 | BSA | 0.2 | DEGEE | 98.3 | MSA | 0.5 | Catechol | 1 | — | — | 0 |
| Condition 3 | BSA | 0.2 | DEGEE | 97.3 | MSA | 0.5 | Catechol | 1 | TT | 1 | 0 |
| Condition 4 | BSA | 0.2 | DEGEE | 95.8 | — | — | Catechol | 2 | TT | 2 | 0 |
| Condition 5 | BSA | 0.2 | DEGBE | 99.3 | MSA | 0.5 | — | — | — | — | 1 |
| Condition 6 | BSA | 0.2 | DEGBE | 98.3 | MSA | 0.5 | Catechol | 1 | — | — | 0 |
| Condition 7 | BSA | 0.2 | DEGBE | 97.3 | MSA | 0.5 | Catechol | 1 | TT | 1 | 0 |
| Condition 8 | BSA | 0.2 | DEGBE | 95.8 | — | — | Catechol | 2 | TT | 2 | 0 |
| Condition 9 | DDBSA | 0.2 | DEGEE | 95.8 | — | — | Catechol | 2 | TT | 2 | 1 |
| Comparison Condition 1 | BSA | 10 | DEGEE | 86 | — | — | Catechol | 2 | TT | 2 | 10 |
| Comparison Condition 2 | BSA | 1 | DEGEE | 95 | — | — | Catechol | 2 | TT | 2 | 10 |
| Comparison Condition 3 | BSA | 0.2 | DEGEE | 97.8 | SA | 1 | — | — | TT | 1 | 10 |

TABLE 1-continued

| | Compositions for Removing Resist | | | | | | | | | | Corrosion |
|---|---|---|---|---|---|---|---|---|---|---|---|
| | Amine Compound | | Glycolether Solvent | | Additive 1 | | Additive 2 | | Additive 3 | | Degree dipping |
| | kind | wt % | kind | wt % | kind | wt % | kind | Wt % | kind | wt % | 30 min. |
| Comparison Condition 4 | TSA | 0.2 | DEGEE | 95.8 | — | — | Catechol | 2 | TT | 2 | 10 |
| Comparison Condition 5 | BSA | 0.2 | DEGEE | 97.8 | — | — | 8-HQ | 1 | TT | 1 | 0 |

BSA: benzenesulfonic acid
TSA: toluenesulfonic acid
DEGBE: diethyleneglycolbutylether
SA: succinic acid
8-HQ: 8-hydroxyquinoline
DDBSA: dodecylbenzenesulfonic acid
DEGEE: diethyleneglycolethylether
MSA: mercaptosuccinic acid
DMAc: N,N-dimethylaceticamide
TT: tolytriazole Two different test samples were prepared for each condition of Table 1. First and second test samples are prepared to verify copper corrosion and resist-removing capability, respectively. The first test sample was prepared by sequentially forming a molybdenum (Mo) layer having a thickness of about 100 Å to about 200 Å and a copper (Cu) layer having a thickness of about 2000 Å on a substrate, coating a resist on the Cu layer, and developing the resist. The second sample was prepared by forming a Cr layer on a substrate, coating a resist on the Cr layer, developing the resist, wet etching and treating with a dry etching gas for an active layer (a-Si:H/n+ a-Si:H). Generally, the resist has a maximum adhesion to a Cr layer. Moreover, the resist is transformed to be irremovable when a dry etching gas is applied.

In Table 1, a corrosion degree is expressed by an integer on a scale of 0 to 10, wherein integer 0 indicates no corrosion, and integer 10 indicates complete corrosion. From results of Table 1, a corrosion inhibitor of free flux type is required to control a galvanic effect between the Cu layer and the Mo layer. Especially in an acid atmosphere, several corrosion inhibitors such as mercapto compound and triazole compound are suggested as the corrosion inhibitor of free flux type.

In the case of conditions 1 and 5, mercapto compound is added and the resulting corrosion degree is excellent. In the case of conditions 2 to 4 and 6 to 8, two kinds of free flux type corrosion inhibitor are added, and the resulting corrosion degree is improved. Moreover, in the case of conditions 1 and 5, even when the mercapto compound is solely added, the corrosion degree is nearly same as that of the case where two kinds of free flux type corrosion inhibitor are added, and total amount of corrosion inhibitors is reduced. Conversely, in the case of comparison conditions, the Cu layer is completely corroded.

The corrosion inhibitor is effective for a reaction where oxygen is reduced on a surface of copper or aluminum, i.e., an oxidation reaction where an oxide film is generated. The corrosion inhibitor reacts with a copper oxide or an aluminum oxide to form a copper or aluminum complex compound in a liquid. The complex compound remaining on a surface functions as electrical and physical protection layers to prevent a surface corrosion and a galvanic effect.

Table 2 shows exemplary removal results of a resist when each composition of Table 1 is used according to the present invention.

TABLE 2

| | Removal Degree | | |
|---|---|---|---|
| | First Test Sample dipping 200 sec. | Second Test Sample dipping 60 sec. | Third Test Sample dipping 210 sec. |
| Condition 1 | 10 | 10 | 10 |
| Condition 2 | 10 | 10 | 10 |
| Condition 3 | 10 | 10 | 10 |
| Condition 4 | 10 | 10 | 10 |
| Condition 5 | 10 | 10 | 10 |
| Condition 6 | 10 | 10 | 10 |
| Condition 7 | 10 | 10 | 10 |
| Condition 8 | 10 | 10 | 10 |
| Condition 9 | 10 | 10 | 10 |
| Comparison Condition 1 | 10 | 10 | 10 |
| Comparison Condition 4 | 10 | 10 | 8 |

Three different test samples were prepared for each condition of Table 2. A first test sample was about 1 cm×4 cm, and was prepared by dry etching an active layer (a-Si:H/n+ a-Si:H) and removing a resist on the active layer. The second test sample was about 1 cm×4 cm, and was prepared by forming a chromium (Cr) layer on a glass substrate, wet etching, treating with a dry etching gas, and removing a resist on the chromium layer. The third test sample was about 2 cm×4 cm, and was prepared by coating a positive photoresist (DTFR-3650B: Dong-Jin semichem) on a glass, baking the resist at about 150° C. for about 25 minutes, and removing the photoresist.

The compositions for removing a resist of Table 1 are heated up to about 70° C., and then the first to third test samples are dipped into the compositions. Residual resist of the first to second test samples was observed by a scanning electron microscope (SEM), and residual resist of the third test sample was even observed by a naked eye. A removal degree of the resist is expressed by an integer on a scale of 0 to 10, wherein integer 0 indicates no removal of the resist, and integer 10 indicates complete removal of the resist.

FIGS. 5A to 5D are schematic cross-sectional views showing a fabricating method of an array substrate for a liquid crystal display device according to an embodiment of the present invention.

Figure 5A:
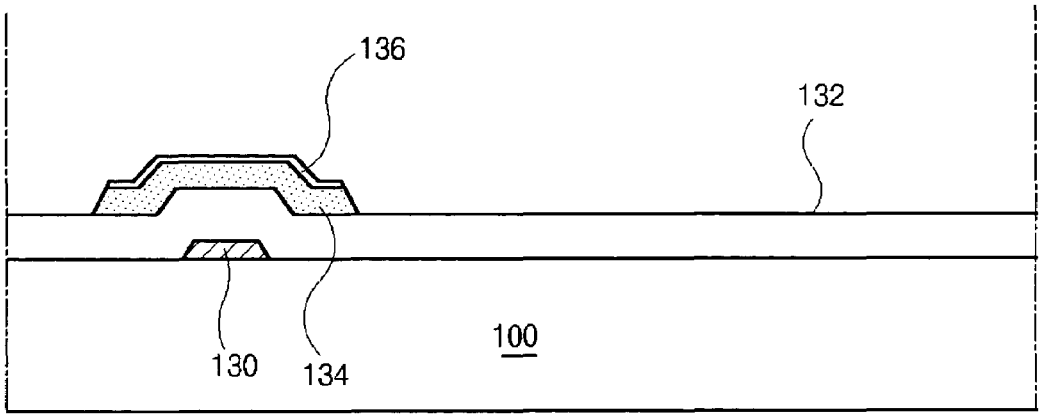
FIGS. 5A to 5D are schematic cross-sectional views showing a fabricating method of an array substrate for a liquid crystal display device according to an embodiment of the present invention.

In FIG. 5A, a gate electrode 130 and a gate line (not shown) are formed on a substrate 100 by depositing and patterning copper (Cu). Even though not shown in FIG. 5A, a barrier layer may be formed between the substrate 100 and the gate electrode 130 to prevent diffusion of Cu into the substrate 100. The gate electrode 130 and the gate line (not shown) are formed through a photolithographic process as shown in FIGS. 3A to 3E. After forming a Cu layer (not shown) on the substrate 100, a photoresist (PR) pattern is formed on the Cu layer (not shown) through exposure and development. After the Cu layer (not shown) is etched using the PR pattern as an etch mask, residual PR is removed by using a composition for removing a copper-compatible resist of Table 1.

A first insulating layer (a gate insulating layer) 132 is formed on the gate electrode 130 and the gate line (not shown) by depositing one of inorganic insulating materials, such as silicon nitride ($SiN_x$) and silicon oxide ($SiO_2$). An active layer 134 of intrinsic amorphous silicon (a-Si:H) and an ohmic contact layer 136 of impurity-doped amorphous silicon (n+ or p+ a-Si:H) are sequentially formed on the first insulating layer 132 over the gate electrode 130. The active layer 134 and the ohmic contact layer 136 have an island shape.

Figure 5B:
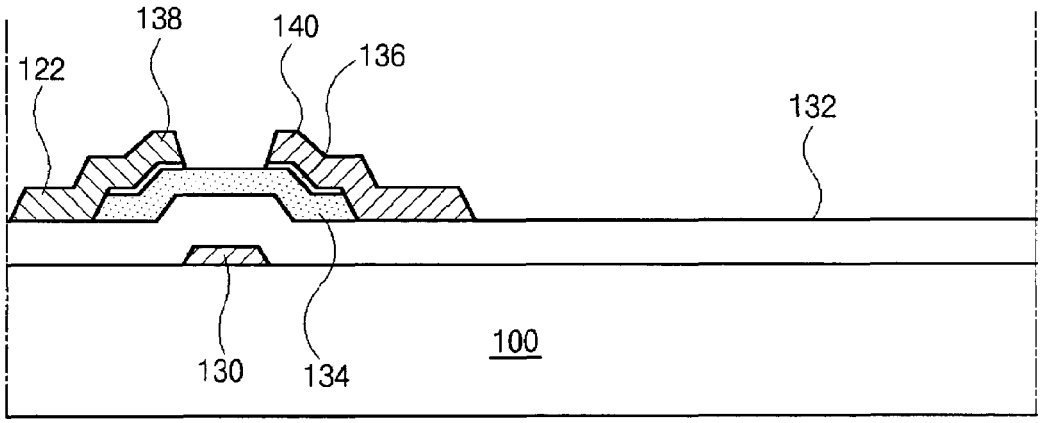

In FIG. 5B, source and drain electrodes 138 and 140 spaced apart from each other are formed on the ohmic contact layer 136 by depositing and patterning a metallic material. The gate electrode 130, the active layer 134, and source and drain electrodes 138 and 140 constitute a thin film transistor (TFT). At the same time, a data line 122 connected to the source electrode 138 is formed on the first insulating layer 132. The source and drain electrodes 138 and 140, and the data line 122 may be made of Cu like the gate electrode 130 and the gate line (not shown). As for the gate electrode 130 and the gate line (not shown), the source and drain electrodes 138 and 140, and the data line 122 of Cu may be formed by using a composition for removing a copper-compatible resist of Table 1.

Figure 5C:
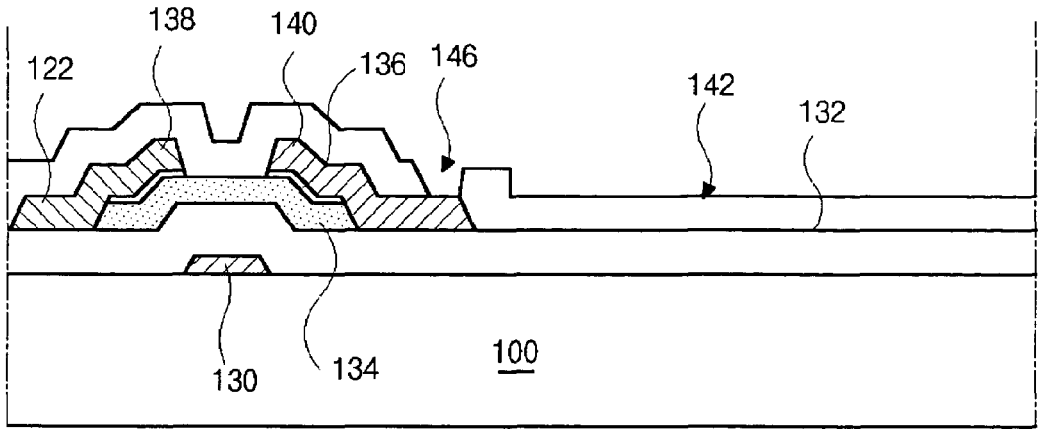

In FIG. 5C, a second insulating layer (a passivation layer) 142 is formed on the source and drain electrodes 138 and 140 by depositing one of inorganic insulating materials, such as silicon nitride ($SiN_x$) and silicon oxide ($SiO_2$), or one of organic insulating materials, such as benzocyclobutene (BCB) and acrylic resin. The second insulating layer 142 has a drain contact hole 146 exposing the drain electrode 140.

Figure 5D:
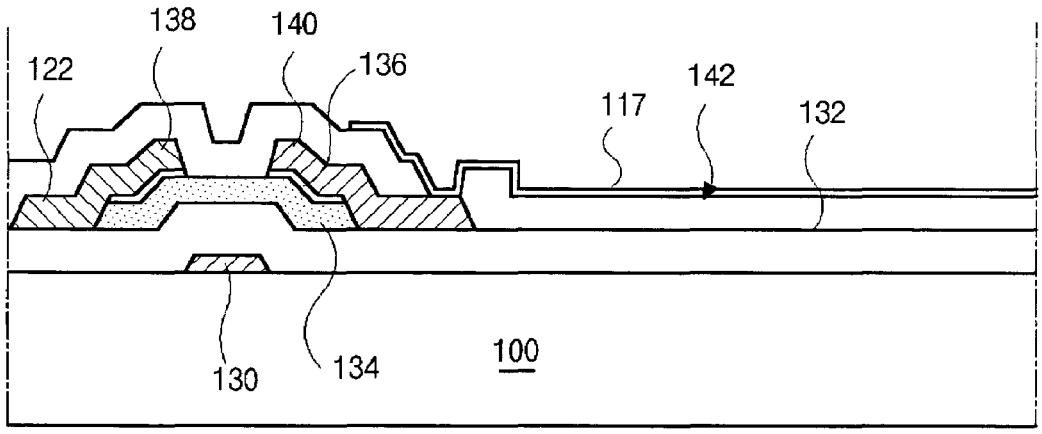

In FIG. 5D, a transparent pixel electrode 117 connected to the drain electrode 140 is formed on the second insulating layer 142.

Since the gate electrode of the TFT is required to have a low resistance, especially for a LCD with high resolution, the gate electrode and the gate line are formed of Cu through a photolithographic process, and the composition for removing copper-compatible resist of Table 1 is used for the photolithographic process.

FIGS. 6A to 6D are schematic cross-sectional views showing a fabricating process of a metal line for a semiconductor device according to another embodiment of the present invention.

Recently, as an integration degree of a semiconductor circuit increases, faster signal transmission is required in the semiconductor circuit. Since copper (Cu) has a lower resistivity than aluminum (Al) or aluminum (Al) alloy such as aluminum-silicon-copper (Al—Si—Cu), Cu is frequently selected as a material for a metal line of the semiconductor circuit. Generally, the metal line of the semiconductor circuit is used for electric connection between semiconductor devices or between a semiconductor device and an external circuit. The metal line is obtained by forming a metal layer filling a contact hole or a via-hole and patterning the metal layer.

Figure 6A:
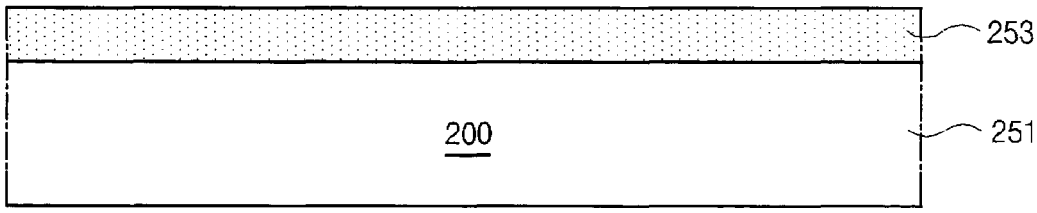
FIGS. 6A to 6D are schematic cross-sectional views showing a fabricating process of a metal line for a semiconductor device according to another embodiment of the present invention.
Figure 6B:
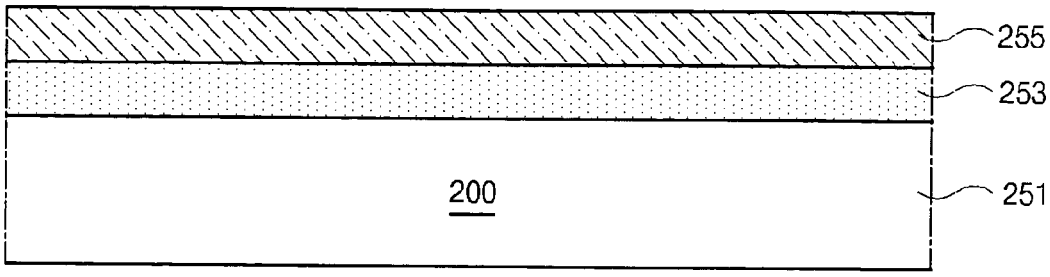

In FIGS. 6A and 6B, an oxide film 253 is formed on a semiconductor substrate 200 such as a wafer and a barrier metal layer 255 is formed on the oxide film 253. The barrier metal layer 253 may be made of titanium nitride (TiN).

Figure 6C:
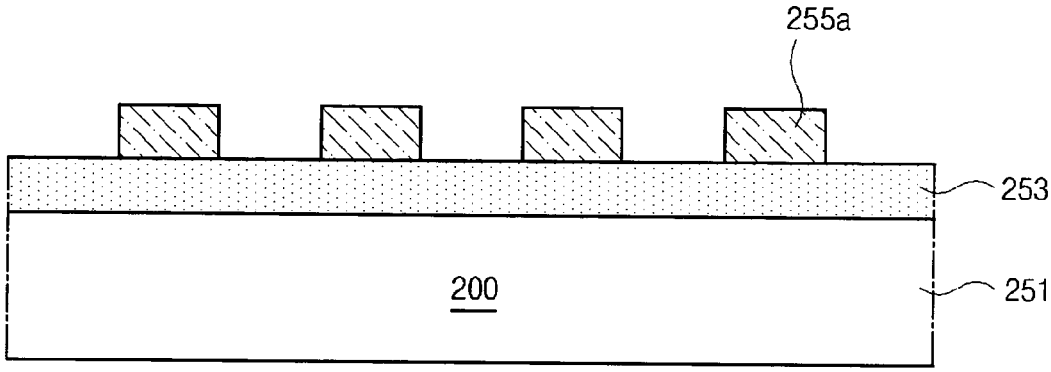

In FIG. 6C, a barrier metal pattern 255*a* is formed through an etching process.

Figure 6D:
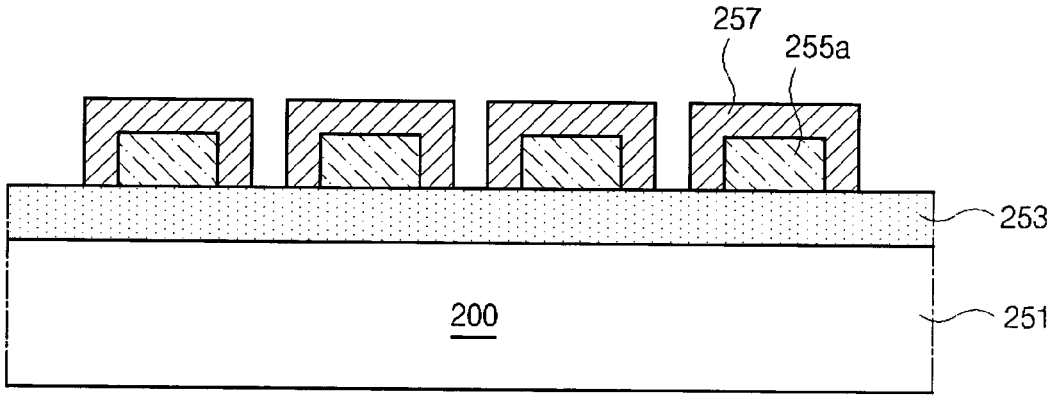

In FIG. 6D, a Cu pattern 257 is formed on the barrier metal pattern 255*a* by depositing and patterning copper. The Cu pattern is formed through a photolithographic process as shown in FIGS. 3A to 3E. After forming a Cu layer (not shown) on the barrier metal pattern 255*a*, a photoresist (PR) pattern is formed on the Cu layer (not shown) through exposure and development. After the Cu layer (not shown) is etched using the PR pattern as an etch mask, residual PR is removed by using a composition for removing a copper-compatible resist of Table 1.

Figure 7A:
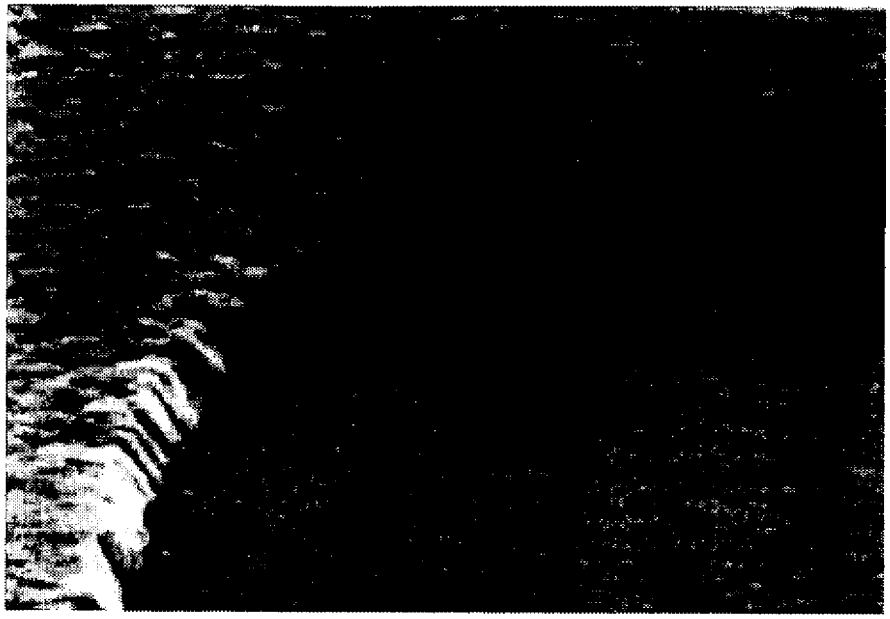
FIG. 7A is a perspective scanning electron microscope (SEM) image showing a corrosion state of an exemplary copper line formed by using a composition for removing copper-compatible resist according to the present invention.
Figure 7B:
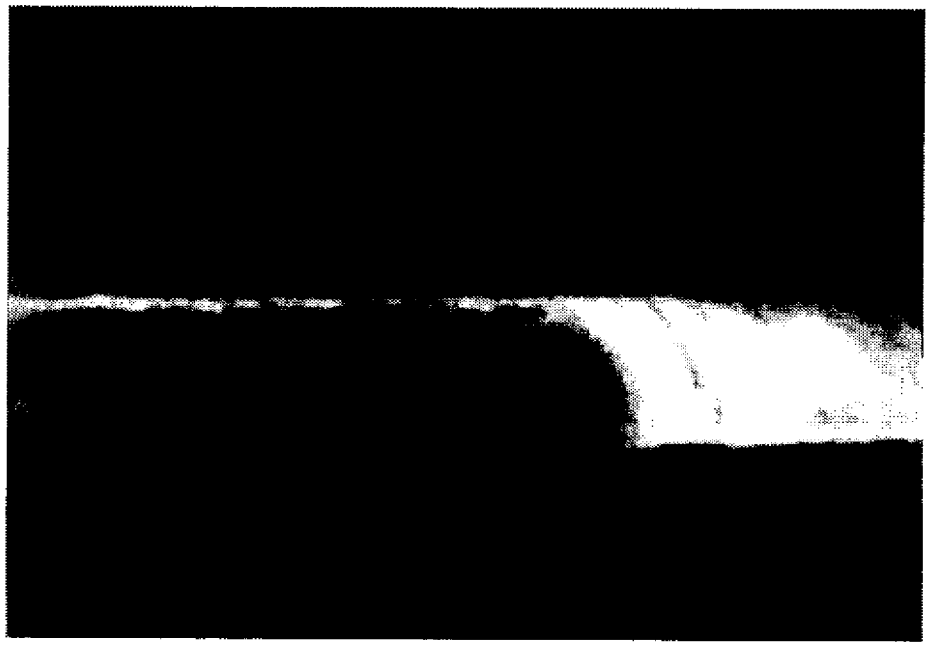
FIG. 7B is a cross-sectional scanning electron microscope (SEM) image showing a corrosion state of an exemplary copper line formed by using a composition for removing copper-compatible resist according to the present invention.

FIGS. 7A and 7B are scanning electron microscope (SEM) images showing a corrosion state of an exemplary copper line formed by using a composition for removing copper-compatible resist according to the present invention.

As shown in FIGS. 7A and 7B, a copper line is not corroded and has a smooth surface because a galvanic effect is minimized by using a composition for removing copper-compatible resist according to the present invention.

When a copper-compatible resist is removed by using a composition of the present invention, the copper-compatible resist is completely removed and a copper line under the copper-compatible resist is not corroded. Therefore, an inferiority resulting from the copper line defect is reduced, and a production yield is improved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A fabricating method of an array substrate for a liquid crystal display device, comprising:

forming a gate line and a gate electrode of copper on a substrate through a photo lithographic process using a photoresist;

removing the photoresist remaining after forming the gate line and the gate electrode with a composition including about 0.1% to about 10% by weight of an alkylbenzenesulfonic compound, about 10% to about 99% by weight of a glycolether compound, and about 0.5% to about 5% by weight of a corrosion inhibitor;

forming a first insulating layer on the gate line and the gate electrode;

forming a semiconductor layer on the first insulating layer over the gate electrode;

forming source and drain electrodes on the semiconductor layer, and a data line connected to the drain electrode;

forming a second insulating layer on the source and drain electrodes and the data line; and forming a pixel electrode on the second insulating layer.

2. The method according to claim 1, wherein the glycolether compound has a composition ratio within about 85% to about 99% by weight.

3. The method according to claim 1, wherein the source and drain electrodes and the data line are formed of the same material as the gate line and the gate electrode by using the composition.

4. The method according to claim 1, wherein the alkylbenzenesulfonic compound includes at least one of benzenesulfonic acid, toluenesulfonic acid, dodecylbenzenesulfonic acid, tetrapropylbezenesulfonic acid and phenolsulfonic acid.

5. The method according to claim 1, wherein the glycolether compound includes at least one of ethyleneglycolmethylether, ethyleneglycolethylether, ethyleneglycolbutylether, diethyleneglycolmethylether, diethyleneglycolethylether, and diethyleneglycolpropylether.

6. The method according to claim 1, wherein the corrosion inhibitor includes one of triazole compound and one of antioxidant.

7. The method according to claim 1, wherein the corrosion inhibitor includes at least one of mercapto compound.

8. The method according to claim 1, wherein the corrosion inhibitor includes one of mercapto compound, one of triazole compound and one of antioxidant.

9. The method according to claim 8, wherein the triazole compound includes tolyltriazole, benzotriazole, aminotriazole, carboxylbenzotriazole, wherein the antioxidant includes succinic acid, benzonic acid, citric acid and catechol, wherein the mercapto compound includes mercaptobenzodiazole, mercaptoethanol, mercaptopropanediol, mercaptosuccinic acid.

10. A fabricating method of a copper line for a semiconductor device, comprising:

forming an oxide film on a semiconductor substrate;

forming a barrier metal pattern on the oxide film;

forming a copper pattern on the barrier metal pattern through a photolithographic process using a photoresist; and removing the photoresist remaining after forming the copper pattern with a composition including about 0.1% to about 10% by weight of an alkylbenzenesulfonic compound, about 10% to about 99% by weight of a glycolether compound, and about 0.5% to about 5% by weight of a corrosion inhibitor.

11. The method according to claim 10, wherein the glycolether compound has a composition ratio within about 85% to about 99% by weight.

12. The method according to claim 10, wherein the alkylbenzenesulfonic compound includes at least one of benzenesulfonic acid, toluenesulfonic acid, dodecylbenzenesulfonic acid, tetrapropylbezenesulfonic acid and phenolsulfonic acid.

13. The method according to claim 10, wherein the glycolether compound includes at least one of ethyleneglycolmethylether, ethyleneglycolethylether, ethyleneglycolbutylether, diethyleneglycolmethylether, diethyleneglycolethylether, and diethyleneglycolpropylether.

14. The method according to claim 10, wherein the corrosion inhibitor includes one of triazole compound and one of antioxidant.

15. The method according to claim 10, wherein the corrosion inhibitor includes at least one of mercapto compound.

16. The method according to claim 10, wherein the corrosion inhibitor includes one of mercapto compound, one of triazole compound and one of antioxidant.

17. The method according to claim 16, wherein the triazole compound includes tolyltriazole, benzotriazole, aminotriazole, carboxylbenzotriazole, wherein the antioxidant includes succinic acid, benzonic acid, citric acid and catechol, wherein the mercapto compound includes mercaptobenzodiazole, mercaptoethanol, mercaptopropanediol, mercaptosuccinic acid.

* * * * *